US009803465B2

(12) United States Patent
Hallundbæk et al.

(10) Patent No.: US 9,803,465 B2
(45) Date of Patent: Oct. 31, 2017

(54) PRESSURE INTEGRITY TESTING SYSTEM

(71) Applicant: WELLTEC A/S, Allerød (DK)

(72) Inventors: Jørgen Hallundbæk, Græsted (DK); Paul Hazel, Aberdeen (GB)

(73) Assignee: Welltec A/S, Allerød (DK)

( * ) Notice: Subject to any disclaimer, the term of this patent is extended or adjusted under 35 U.S.C. 154(b) by 576 days.

(21) Appl. No.: 14/357,657

(22) PCT Filed: Nov. 29, 2012

(86) PCT No.: PCT/EP2012/073916
§ 371 (c)(1),
(2) Date: May 12, 2014

(87) PCT Pub. No.: WO2013/079574
PCT Pub. Date: Jun. 6, 2013

(65) Prior Publication Data

US 2014/0318770 A1 Oct. 30, 2014

(30) Foreign Application Priority Data

Nov. 30, 2011 (EP) ..... 11191286

(51) Int. Cl.
*E21B 33/124* (2006.01)
*E21B 47/06* (2012.01)
(Continued)

(52) U.S. Cl.
CPC ..... *E21B 47/0006* (2013.01); *E21B 33/1243* (2013.01); *E21B 47/06* (2013.01); *E21B 47/10* (2013.01)

(58) Field of Classification Search
CPC ..... E21B 33/124; E21B 33/1243; E21B 33/1246; E31B 47/06
See application file for complete search history.

(56) References Cited

U.S. PATENT DOCUMENTS 4,320,800 A * 3/1982 Upchurch ..... E21B 33/1246 166/106
4,353,249 A 10/1982 Lagus et al.
(Continued)

FOREIGN PATENT DOCUMENTS

CN 101878351 A 11/2010
EP 1 455 052 9/2004
(Continued)

OTHER PUBLICATIONS

International Search Report and Written Opinion for PCT/EP2012/073916, dated Feb. 5, 2013.

*Primary Examiner* — George Gray
(74) *Attorney, Agent, or Firm* — Nixon & Vanderhye P.C.

(57) ABSTRACT

An annular barrier system for proving a testable annular barrier arranged between a first metal casing or borehole and a second metal casing. The annular barrier system has a first annular barrier and a second annular barrier, each barrier including a tubular part made of metal extending in a longitudinal direction for mounting as part of the second metal casing, an expandable metal sleeve surrounding and connected with the tubular part and defining an annular barrier space, and a first fluid passage in the tubular part for letting fluid into the annular barrier space to expand the sleeve. The annular barrier system further includes a sensor, and when the expandable sleeves are expanded to abut the first metal casing or borehole, a first annular space is at least partly defined between the annular barriers. The sensor is arranged to determine a condition of the annular space in order to test the isolation ability of at least one of the annular barriers.

19 Claims, 12 Drawing Sheets

(51) Int. Cl.
*E21B 47/10* (2012.01)
*E21B 47/00* (2012.01)

(56) References Cited

U.S. PATENT DOCUMENTS

| | | | | |
|---|---|---|---|---|
| 2005/0028980 | A1* | 2/2005 | Page | E21B 33/035 166/285 |
| 2005/0199401 | A1 | 9/2005 | Patel et al. | |
| 2009/0272530 | A1* | 11/2009 | Duguid | E21B 41/0064 166/250.17 |
| 2010/0122812 | A1 | 5/2010 | Corre et al. | |
| 2011/0061863 | A1* | 3/2011 | Ramakrishnan | E21B 49/008 166/250.14 |

FOREIGN PATENT DOCUMENTS

| | | |
|---|---|---|
| EP | 2317068 | 5/2011 |
| RU | 2 165 516 C1 | 4/2001 |
| RU | 2 173 379 C2 | 9/2001 |
| RU | 2 302 512 C2 | 7/2007 |
| RU | 2 362 005 C2 | 7/2009 |
| RU | 2 391 502 C2 | 6/2010 |
| WO | WO 01/18357 | 3/2001 |
| WO | WO 2005/014971 A1 | 2/2005 |
| WO | WO 2007/039836 A2 | 4/2007 |

* cited by examiner

PRESSURE INTEGRITY TESTING SYSTEM

This application is the U.S. national phase of International Application No. PCT/EP2012/073916, filed 29 Nov. 2012, which designated the U.S. and claims priority to EP Application No. 11191286.1, filed 30 Nov. 2011, the entire contents of each of which are hereby incorporated by reference.

FIELD OF THE INVENTION

The present invention relates to an annular barrier system for proving a testable annular barrier arranged between a first metal casing or borehole and a second metal casing, the second metal casing having an outer face. The present invention also relates to a method of testing pressure integrity of a well using an annular barrier system as described above.

BACKGROUND ART

When arranging an intermediate casing in a conductor pipe, or when arranging a production casing in an intermediate casing, an annular isolation packer is set in the annular space to prevent the fluid from the surrounding formation from flowing into the annular space. The pressure integrity between two tubulars is very important and the annulus between them is tested on a regular basis. If the pressure integrity is broken, the operator can no longer prove well control, and the well is shut down.

Therefore, it is very important that these annular packers seal off the formation pressure. However, it is very difficult to leak-test the packer without at the same time breaking the pressure integrity, as the formation or cement is on one side, and thus, injection of a tracer into the formation fluid will break the integrity since the casing is then also penetrated.

SUMMARY OF THE INVENTION

It is an object of the present invention to wholly or partly overcome the above disadvantages and drawbacks of the prior art. More specifically, it is an object to provide an improved annular packer system which can be leak-tested without at the same time breaking the pressure integrity.

The above objects, together with numerous other objects, advantages, and features, which will become evident from the below description, are accomplished by a solution in accordance with the present invention by an annular barrier system for proving a testable annular barrier arranged between a first metal casing or borehole and a second metal casing, the second metal casing having an outer face, the annular barrier system comprising:

- a first annular barrier and a second annular barrier, each barrier comprising:
- a tubular part made of metal extending in a longitudinal direction for mounting as part of the second metal casing,
- an expandable metal sleeve surrounding and being connected with the tubular part and defining an annular barrier space, and
- a first fluid passage in the tubular part for letting fluid into the annular barrier space to expand the sleeve, and the annular barrier system further comprising a sensor arranged in connection with the tubular part, and when the expandable sleeves are expanded to abut the first metal casing or borehole, a first annular space is defined between the annular barriers, wherein the sensor is arranged to determine a condition of the annular space in order to test the isolation ability of at least one of the annular barriers.

Annular barriers may be arranged adjacent to each other.

Moreover, the sensor may measure a property of the fluid to determine the condition of the annular space, the property being a temperature, a pressure, a presence of gas, or a presence of a chemical tracer.

In one embodiment, the sensor may be arranged in the annular space.

In another embodiment, the sensor may be arranged in at least one of the annular barriers or be connection with at least one of the annular barriers.

In a third embodiment, the sensor may be arranged in a tool arranged opposite the annular space inside the second metal casing.

In another embodiment, the sensor may be arranged on an outer face of the expandable sleeve.

In a yet another embodiment, the sensor may be arranged on an outside of the expandable sleeve.

Further, the sensor may be a strain gauge or a piezo crystal.

Such a strain gauge may be fastened to the outside of the expandable sleeve, measuring an extension of the expandable sleeve.

Also, the strain gauge may be electrically connected with the readout unit and/or the communication unit by means of wire which is adhered to the outer face of the expandable sleeve in a meander form so that the wire is long enough to extend from the strain gauge to the unit without breaking, also after the expandable sleeve has been expanded.

Piezo crystal may be embedded in the expandable sleeve.

The annular barrier system as described above may further comprise a readout unit arranged at the outer face of the tubular part and in electrical communication with the sensor.

Additionally, the annular barrier system as described above may further comprise a communication unit arranged at the outer face of the tubular part for communicating data from the sensor to a reader.

Such a reader may be arranged in a tool opposite the annular space.

Moreover, the communication unit may be connected with the readout unit.

Furthermore, the communication unit may be connected with a processor.

Said sensor may be connected with an amplifier.

Also, the sensor may be a hydrostatic switch.

In another embodiment, the annular barrier system may further comprise a gas chamber having an outlet in fluid communication with the annular space when a valve arranged in the outlet is opened for letting gas inside the gas chamber and into the annular space.

By having a gas chamber arranged between two annular barriers, one of the annular barriers can be pressure-tested, i.e. tested for any leaks across that annular barrier and thus for whether the pressure integrity of the well is satisfactory and intact.

In an embodiment, the first communication unit may be arranged in a first annulus arranged between the second metal casing and the first metal casing or the borehole.

In another embodiment, the expandable sleeve of the first annular barrier may be connected with the tubular part by means of two connection parts.

Furthermore, the gas chamber may be an annular chamber.

Also, the gas chamber may be arranged in the connection part.

Moreover, the gas chamber may be arranged surrounding the second metal casing.

Additionally, the gas chamber may comprise a gas comprising a chemical tracer.

Further, the valve may be remotely controllable, e.g. by means of a magnet.

The annular barrier system as described above may further comprise a leak detection tool submergible into the second metal casing.

Said leak detection tool may comprise a gas detection unit.

Also, the leak detection tool may comprise a pressure measuring unit. The pressure measuring unit may use acoustics, such as ultrasound, or electromagnetic radiation.

Furthermore, the leak detection tool may comprise a temperature unit, such as laser.

In addition, the expandable sleeve of each annular barrier may have two ends being fixedly connected with the tubular part.

By having both ends fixedly connected, the seal connection between the expandable sleeve and the tubular part can be made extremely tight compared to having sealing elements, typically chevron seals or O-rings for providing a slidable connection, in the connection between the tubular part and the expandable sleeve.

Also, the communication unit may comprise a wireless sending unit sending data from the communication unit to the reader by means of inductance, Wlan, zigbee, radio frequency, etc.

Moreover, the first fluid passage may be arranged in the tubular part providing a fluid communication with an inside of the tubular part and the expandable space.

In an embodiment, the first fluid passage may be arranged in the connection part connecting the expandable sleeve with the tubular part.

The annular space may be at least partly filled with cement.

Further, the expandable sleeve may be connected with the tubular part by means of a connection part comprising a pressure amplification unit having an opening in fluid communication with an inside of the tubular part, and a first chamber and a first piston moving in the first chamber when a pressure in the tubular part increases, the first piston being connected to a second piston moving in the gas chamber, forcing the gas into the annular space when the first piston moves.

The annular barrier system described above may further comprise the second metal casing, a third metal casing arranged inside the second metal casing, a third annular barrier and fourth annular barrier, the tubular part of the third and fourth annular barrier extending in a longitudinal direction for mounting as part of the third metal casing, and a second sensor arranged in connection with the tubular part, and when the expandable sleeves of the third and fourth annular barriers are expanded to abut the second metal casing, a second annular space may be defined between the third and fourth annular barriers, wherein the second sensor may be arranged to determine a condition of the second annular space in order to test the isolation ability of at least one of the third or fourth annular barriers.

The annular barrier system may further comprise a second communication unit connected with the third metal casing and/or the second sensor to receive information from the sensor arranged in the first annular space.

The communication unit may also communicate information from the second sensor to the top of the well or to a tool arranged in the third metal casing In an embodiment, the second communication unit may be arranged in a second annulus arranged between the second metal casing and the third metal casing.

Furthermore, the fifth sensor may be arranged in a second annulus arranged between the second metal casing and the third metal casing.

The annular barrier system may further comprise a fourth sensor arranged in the first annulus arranged between the first metal casing and the second metal casing.

Moreover, the annular barrier system may further comprise a fourth metal casing arranged inside the third metal casing, a fifth annular barrier and sixth annular barrier, the tubular part of the fifth and sixth annular barrier extending in a longitudinal direction for mounting as part of the fourth metal casing, and a third sensor arranged in connection with the tubular part, and when the expandable sleeves of the fifth and sixth annular barriers are expanded to abut the third metal casing, a third annular space may be defined between the fifth and sixth annular barriers, wherein the third sensor may be arranged to determine a condition of the third annular space in order to test the isolation ability of at least one of the fifth and sixth annular barriers.

Additionally, the annular barrier system may further comprise a third communication unit connected with the fourth metal casing and/or a third sensor to receive information from the second sensor arranged in the second annular space.

In an embodiment, the third communication unit may be arranged in a third annulus arranged between the second metal casing and the third metal casing.

The annular barrier system may further comprise a sixth sensor arranged in a third annulus arranged between the second metal casing and the third metal casing.

The present invention also relates to a method of testing a pressure integrity of a well using a system as described above, the method comprising the steps of:

expanding the expandable sleeves of the first and second annular barriers, thereby providing an annular space, creating an increased property of the fluid in the annular space, and measuring the property by the sensor.

This increased property may be created by the entrapment of fluid inside the annular space when expanding the expandable sleeves.

Said method may further comprise the step of lowering a tool comprising the sensor into the well to measure the property of the fluid in the annular space.

Also, said method may comprise the steps of letting gas into the annular space and testing for gas from the gas chamber inside the casing.

Finally, said method may further comprise the step of opening the valve.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
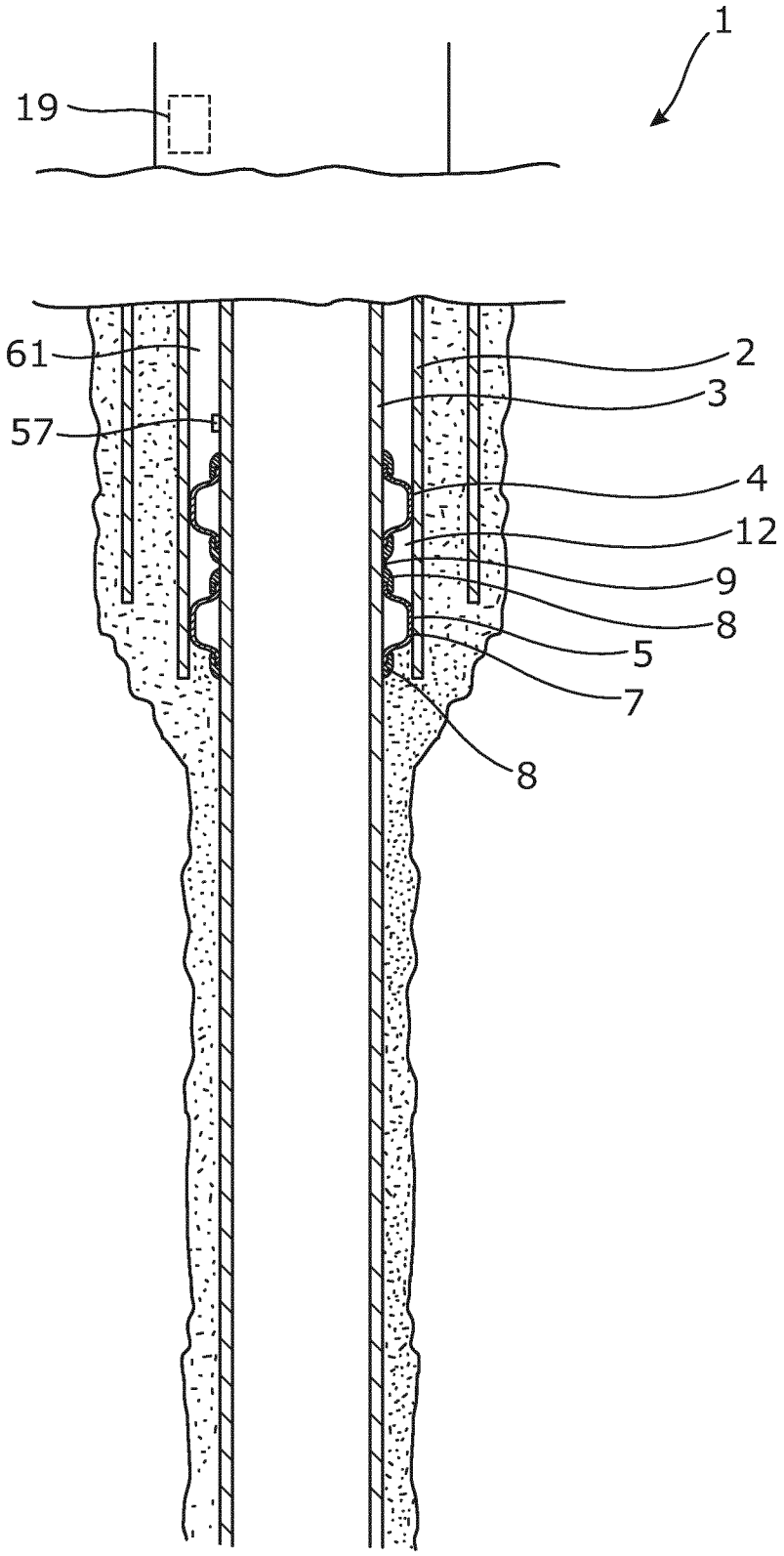
FIG. 1 shows an annular barrier system arranged in a completion.
Figure 2:
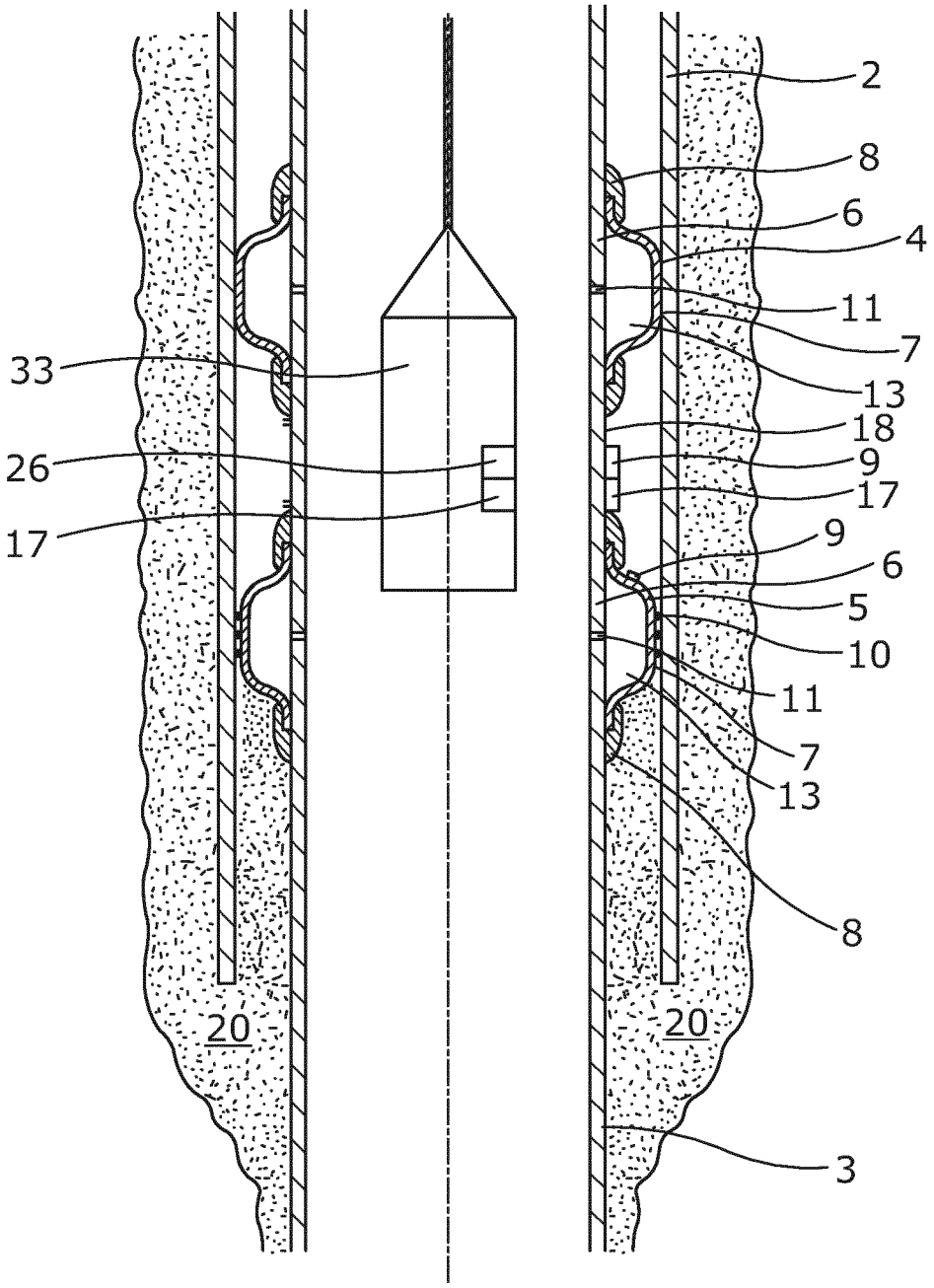
FIG. 2 shows a cross-sectional view of one embodiment of the annular barrier system.

FIG. 1 shows an annular barrier system 1 for proving a testable annular barrier arranged between a first metal casing 2 and a second metal casing 3. The annular barrier system 1 comprises a first annular barrier 4 and a second annular barrier 5 arranged spaced apart. As shown in FIG. 2, each barrier comprises a tubular part 6 and an expandable sleeve 7 made of metal surrounding the tubular part 6 and being connected with the tubular part, the expandable sleeve 7 defining a barrier space 13, and the annular barriers 4, 5 further comprise a first fluid passage 11 for letting fluid into the barrier space 13 to expand the metal sleeve 7. The tubular part 6 extends in a longitudinal direction for mounting as part of the second metal casing 3, and the annular barriers 4, 5 are arranged adjacent to each other. When the expandable sleeves 7 are expanded to abut the first metal casing 2, the sleeves form an annular space 12 between the annular barriers, the first metal casing 2 and the second metal casing 3. The annular barrier system 1 further comprises a sensor 9 connected with the tubular part for testing the isolation ability of at least one of the annular barriers. When expanding the annular barriers to provide isolation between a first casing 2 and a second casing 3, as shown in FIG. 1, the sealing properties of the annular barrier need to be confirmed. The sensor is therefore arranged to measure a condition of the annular space, such as the pressure of the fluid inside the annular space. When expanding the annular barriers, the pressure in the annular space increases, and if the annular barriers are tight, this pressure increase is measured in the sensor over a period of time from expanding the annular barriers. If the sensor measures an immediate decrease of pressure in the annular space after expansion of the sleeves, the annular barriers are incapable of holding the fluid within the annular space, and thus, at least one of the annular barriers is not sufficiently tight.

The sensor 9 of FIG. 1 is arranged in the first annular space 12 and measures a property, such as the pressure, of the fluid to determine a condition of at least one of the annular barriers in order to test the isolation ability of at least one of the annular barriers. The pressure sensor is fastened on an outer face 18 of the tubular part of one of the annular barriers. The sensor is a transducer measuring the pressure over a period of time while expanding the sleeves of the annular barriers and in a predetermined period of time after the expansion. The sensor is powered by a battery, and since the measuring occurs not long after the annular barriers are run into the borehole, the battery can be a small commercially available battery.

In another embodiment, the sensor 9 is a temperature sensor measuring the temperature of the fluid present in the annular space. The temperature increases momentarily when pressure increases, and thus, by measuring the temperature, the isolation ability of at least one of the annular barriers can be tested. If the temperature does not increase while expanding the sleeves, the annular barriers are not tight. The temperature sensor is arranged on the outer face of the tubular part.

In another embodiment, the sensor is a strain gauge or a piezo crystal fastened on an outer face of the expandable sleeve and measuring an extension of the expandable sleeve or embedded in the expandable sleeve. Since the distance between the first and second casings is well-defined and predetermined, the expansion of the expandable sleeve can be calculated precisely, and by measuring the extension of the expandable sleeve, it can be determined if the expandable sleeve has been expanded sufficiently to provide a sufficient seal.

Figure 3:
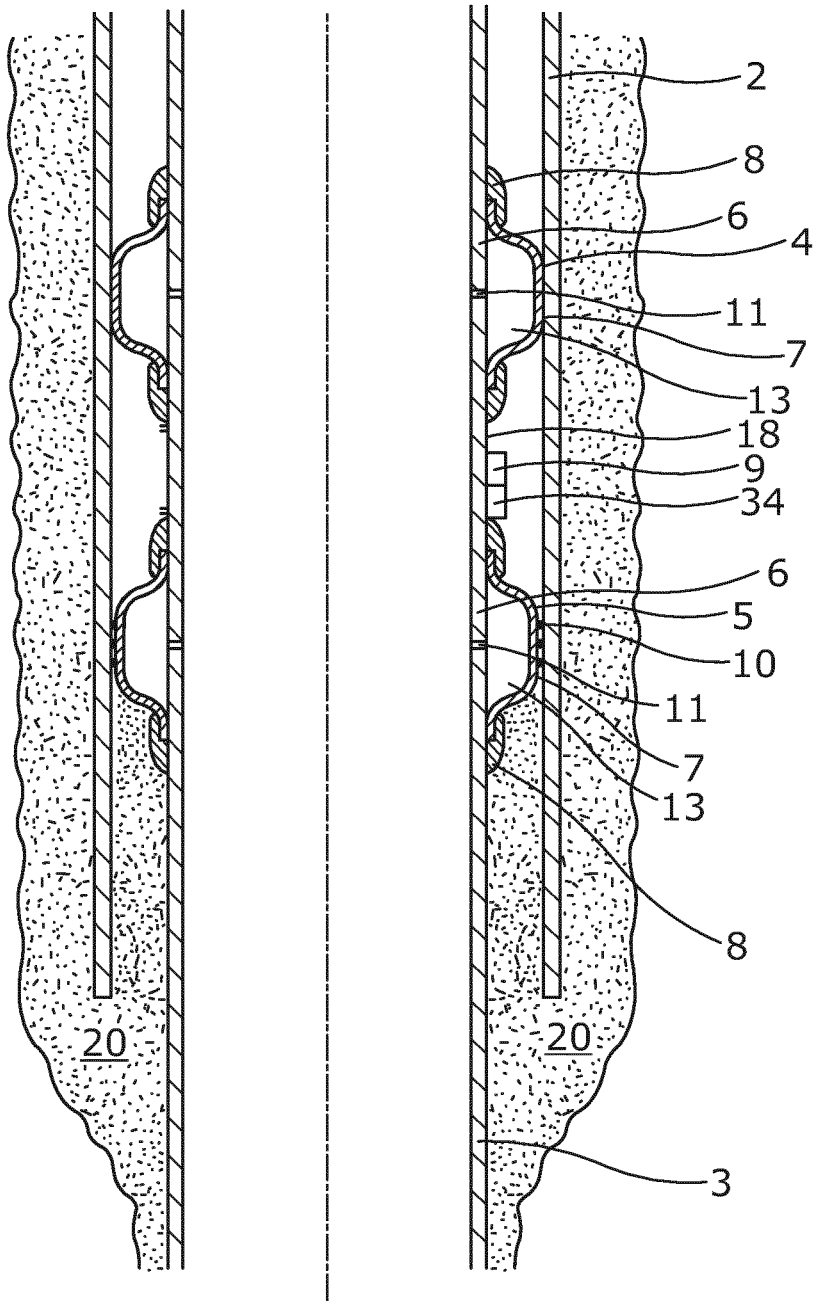
FIG. 3 shows a cross-sectional view of another embodiment of the annular barrier system.

In FIGS. 2 and 3, the sensor 9 is electrically connected with a readout unit 34 in FIG. 3 and/or a communication unit 17 in FIG. 2, respectively, by means of wire. If the sensor 9 is a strain gauge or a piezo crystal, the wire is adhered to the outer face of the expandable sleeve in a meander form so that the wire is long enough to extend from the strain gauge to the unit without breaking during expansion of the expandable sleeve.

To retrieve the measured data from the sensor, the communication unit is arranged on the outer face 18 of the tubular part 6 for communicating data from the sensor 9 to a reader 26, as shown in FIG. 2, which reader is arranged in a tool 33 submerged into the well, as shown in FIG. 3. In another embodiment, the communication unit communicates with a processor 19 arranged at the top of the well as shown in FIG. 1 via intermediate communication units which are wirelessly linked (not shown). The readout unit 34 may also be connected with the communication unit 17 to communicate the data received by the readout unit to e.g. a tool arranged opposite the communication unit 17 in the second casing 3.

Figure 4:
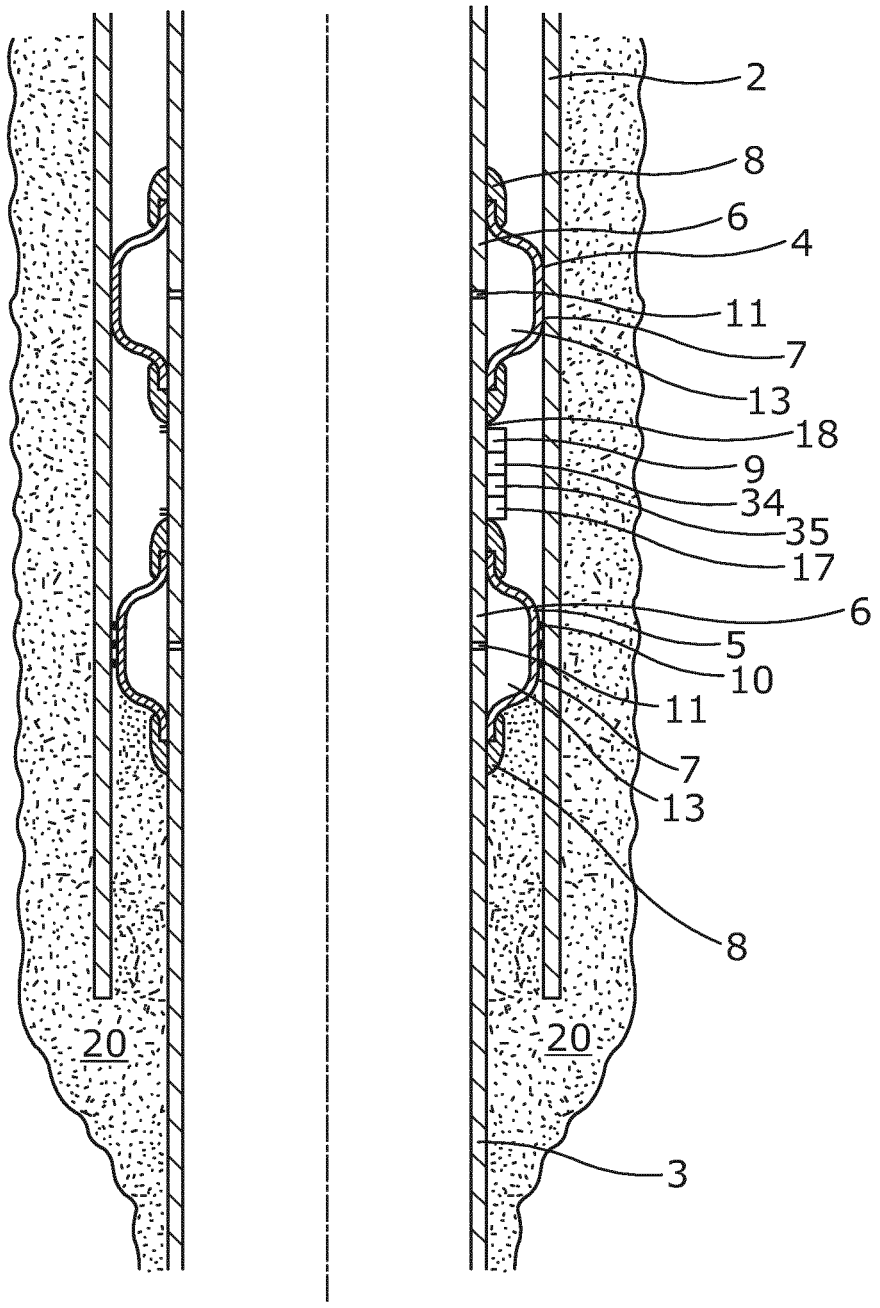
FIG. 4 shows a cross-sectional view of yet another embodiment of the annular barrier system.

As shown in FIG. 4, the communication unit 17 is connected with a processor 35 arranged on the outer face 18 of the tubular part. The sensor 9 measuring the property of e.g. the fluid sends the measured data to the readout unit 34 which sends it further on to the processor 35 and further to the communication unit 17. The processor 35 converts the data into a signal representing whether the annular barrier is tight or not, and not representing the actual data measured by the sensor.

Figure 5:
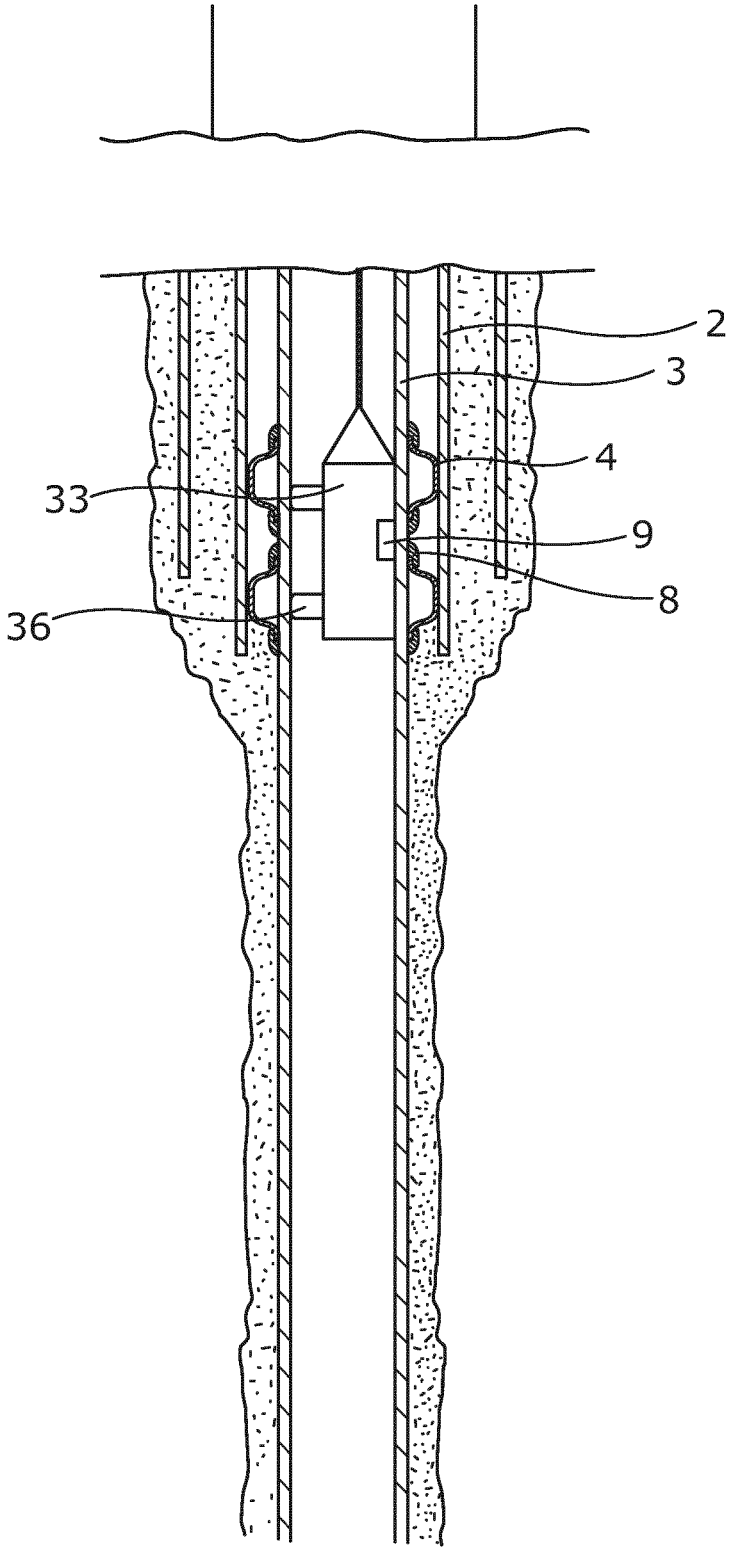
FIG. 5 shows a view of yet another embodiment of the annular barrier system.

In FIG. 5, the sensor 9 is arranged in the tool 33, measuring the pressure or the temperature increase in the annular space if the annular barriers are sufficiently tight after expansion. The tool 33 is arranged opposite the annular space inside the second metal casing 3 in order to sense the property of the fluid. The sensor is an acoustic transceiver emitting an acoustic signal, such as ultrasonic waves, and the transceiver receives the bouncing high-frequency sound waves in order to determine a property of the fluid, and thus if the annular barriers provide a sufficient isolation zone. The tool 33 comprises anchors 36 in order to press the tool wall and thus the sensor 9 against the wall of the second casing to obtain an improved measurement of the property of the fluid in the annular space, such as the pressure or temperature.

The sensor arranged in the tool may also emit electronic radiation, such as laser, in order to determine the isolation ability of the annular barriers.

The sensors are thus able to determine whether both annular barriers are capable of holding the fluid inside the annular space and thus provide an isolation between the first and the second metal casings.

Figure 6:
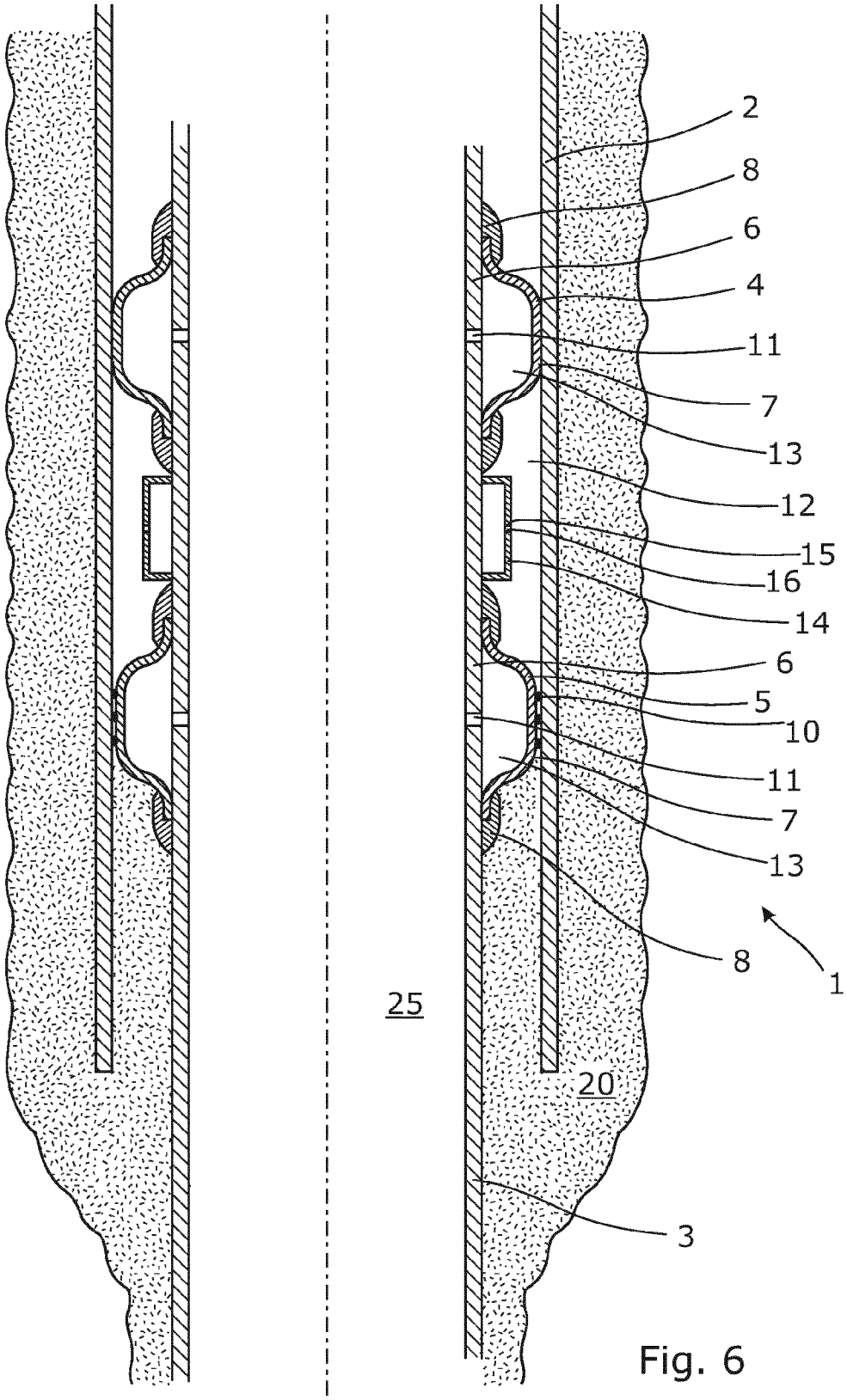
FIG. 6 shows a cross-sectional view of an annular barrier system.

In FIG. 6, the annular barrier system 1 further comprises a gas chamber 14 having an outlet 15 in fluid communication with the annular space when a valve 16 arranged in the outlet 15 is opened for letting gas inside the gas chamber 14 into the annular space 12. When gas is let out of the gas chamber 14 into the annular space 12, the first barrier 4 can be leak-tested by investigating the fluid flowing in the well if any of the gas from the gas chamber can be identified. The gas may contain some kind of chemical tracer in order to identify more easily if the first barrier is leaking or not. By arranging an additional sensor in the well head or inserting it in the first annulus above the first annular barrier, this sensor is able to detect any chemicals in the fluid, primarily gas, in the annular space above the first annular barrier. If no chemicals are detected by the sensor, the first annular barrier has sufficient isolation ability to maintain the fluid inside the annular space between the two expanded sleeves, and thus, the annular barrier system provides an isolation barrier between the first and the second casing. By having a gas chamber inside the annular space provided by the expandable sleeves, the isolation ability of the first annular barrier can be tested.

An annular barrier system comprising both a gas chamber and a sensor arranged inside the annular space provided by the expandable sleeves is able to test if the first annular barrier is sufficiently tight even though the sensor inside the annular space has already tested whether the annular space is leaking. Thus, the combination of a gas chamber and a sensor inside the annular space makes it possible to test if the first annular barrier is sufficiently tight even though the second annular barrier is not tight.

As can be seen in FIG. 6, the second barrier 5 abuts the cement 20 in the cemented part on one side of the sleeve 7, and on the other side the second barrier 5 abuts the first annular space 12. The second annular barrier can thus not be leak-tested by identifying the gas in the fluid flowing in the second metal casing, since gas leaking over the second annular barrier will enter into the cemented part.

The expandable sleeve of the first annular barrier is connected with the tubular part by means of two connection parts 8. In FIG. 6, the connection parts 8 fixedly connect the expandable sleeves to the tubular parts of the annular barriers. In this way, the pressure integrity is not compromised by leaking sealing elements situated between the connection parts and the tubular parts. The only potential leak over the first annular barrier may be in the event that the expandable sleeve does not completely seal against the inner face of the first metal casing.

The gas chamber is an annular chamber surrounding the second metal casing. The outlet of the chamber is arranged in the wall of the chamber housing, and the valve is fastened in the outlet by means of a screw connection or a similar connection. When expanding the expandable sleeves of the annular barriers, the pressure in the annular space increases to a pressure above the pressure inside the metal casing. The valve may be pressure-activated so as to open at this pressure increase, or the valve may be activated wirelessly from a signal from surface or in another way remotely controllable without penetrating the second metal casing and thus compromising the pressure integrity. In another embodiment, the valve comprises a magnet and when inducing a magnetic field within the casing, the magnet can be moved to open the valve.

Figure 7:
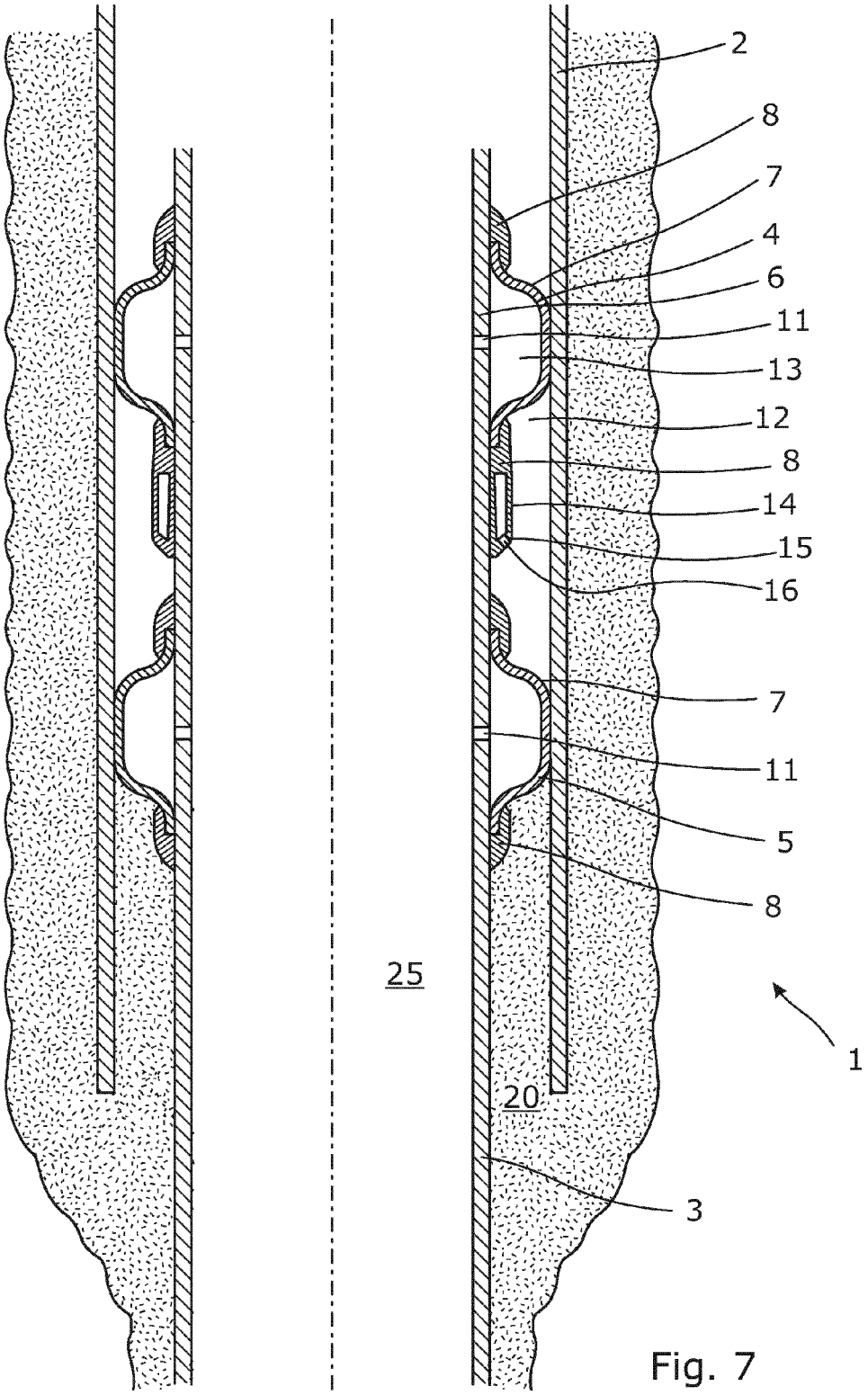
FIG. 7 shows a cross-sectional view of another embodiment of the annular barrier system.

In FIG. 7, the gas chamber is arranged in one of the connection parts of one of the annular barriers which, in this case, is one of the connection parts of the first annular barrier facing the annular space 12. This connection part is thus prolonged to comprise the gas chamber as shown, and the outlet 15 faces the second barrier. When the valve is opened, the gas enters the annular space.

The annular space may also be substantially filled with cement or a similar material so that the sleeve of the second annular barrier is expanded in the cement. The gas may still enter the space and penetrate the cement if this is not providing a sealing connection itself, thus leak-testing the first annular barrier.

Figure 9:
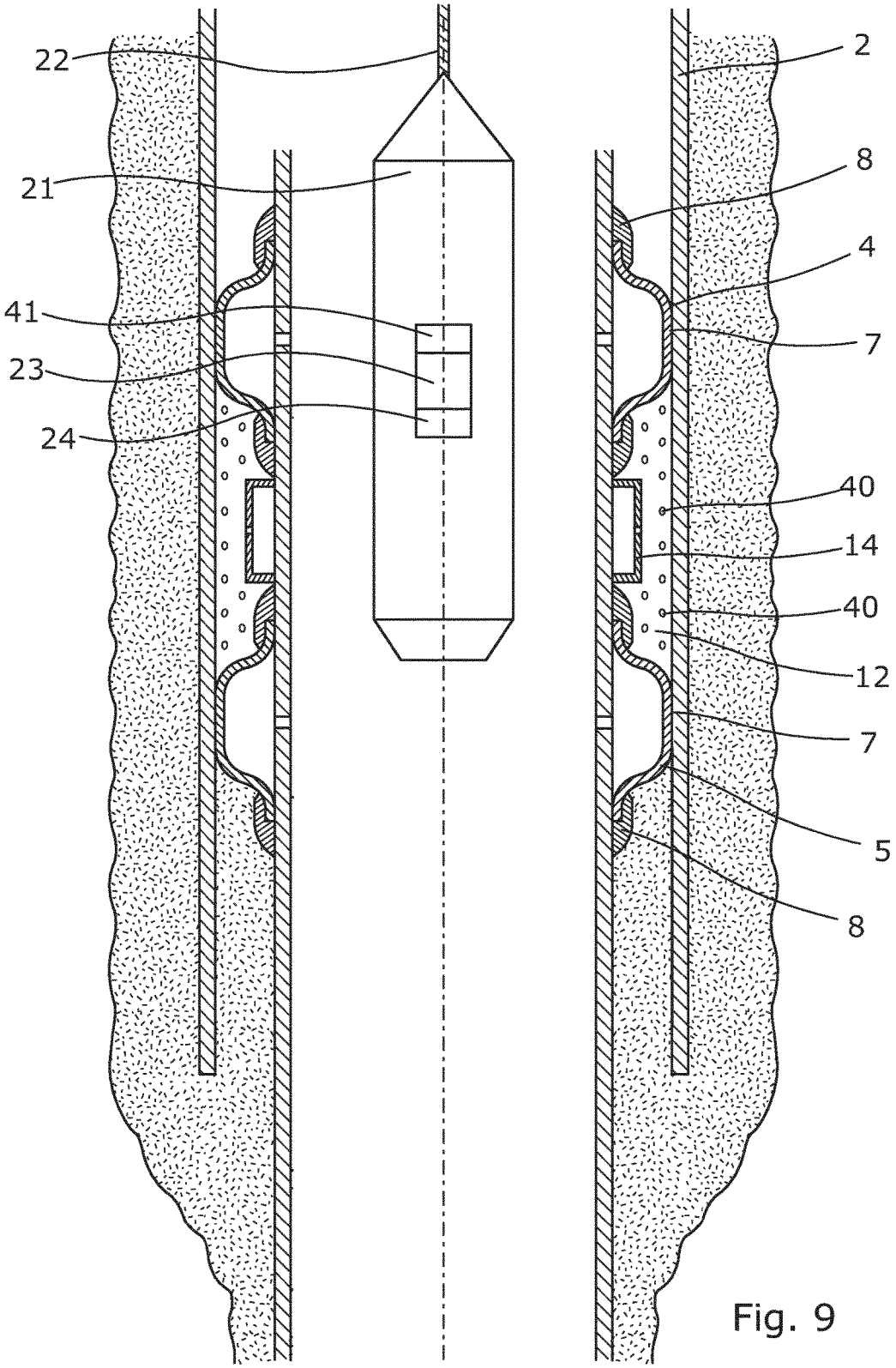
FIG. 9 shows a cross-sectional view of a yet another embodiment of the annular barrier system.

The annular barrier system further comprises a leak detection tool 21, as shown in FIG. 9, submergible into the second metal casing by means of a wireline 22 for testing if gas has been able to pass one of the annular barriers. The leak detection tool comprises a gas detection unit 23, a pressure measuring unit 24 and/or a temperature unit 41, such as laser. The pressure testing unit is using acoustics, such as ultrasound, or electromagnetic radiation. When the expandable sleeves of the annular barriers are expanded, the pressure in the annular space increases and becomes somewhat higher than in the well pressure or the formation pressure. The leak detection tool having the pressure measuring unit 24 thus measures the pressure within the annular space over time, and if the pressure within the annular space falls to the surrounding pressure either in the well or in the formation, at least one of the annular barriers is leaking. If no gas 40 from the gas chamber is identified in the fluid in the casing, the leak comes from a leakage across the second annular barrier and not the first. In this event, the pressure integrity is still intact, however, if gas from the gas chamber is identified in the fluid, the first annular barrier is leaking and the pressure integrity cannot be guaranteed.

The leak detection tool may comprise merely a gas detection unit 23, and thus, gas leaking out through the first annular barrier can be detected, thereby enabling leak-testing of the first annular barrier.

Thus, the property may be a temperature, a pressure, a presence of gas or a presence of a chemical tracer. If the property to be measured does not vary very much, the sensor is connected with an amplifier.

The sensor may also be a hydrostatic switch which switches when reaching a predetermined increase in pressure.

Figure 8:
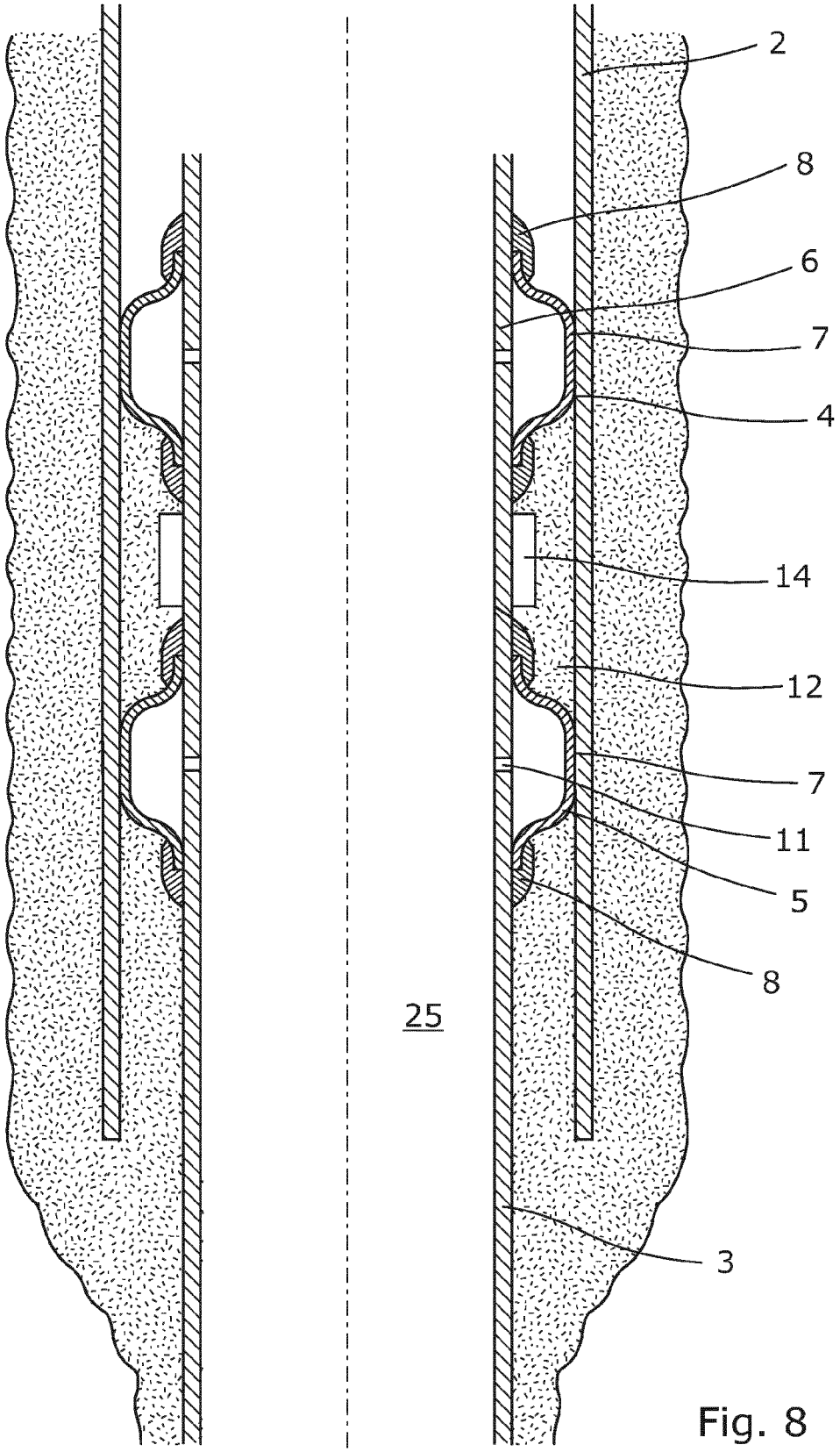
FIG. 8 shows a cross-sectional view of yet another embodiment of the annular barrier system.

In FIGS. 6-8, the first fluid passage 11 is arranged in the tubular part 6, providing a fluid communication with an inside 25 of the tubular part and the barrier space 13. In another embodiment, the first fluid passage is also arranged in the connection part connecting the expandable sleeve with the tubular part, and the fluid expanding the sleeve is thus let from the inside 25 of the tubular part through the connection part into the barrier space 13.

Figure 10:
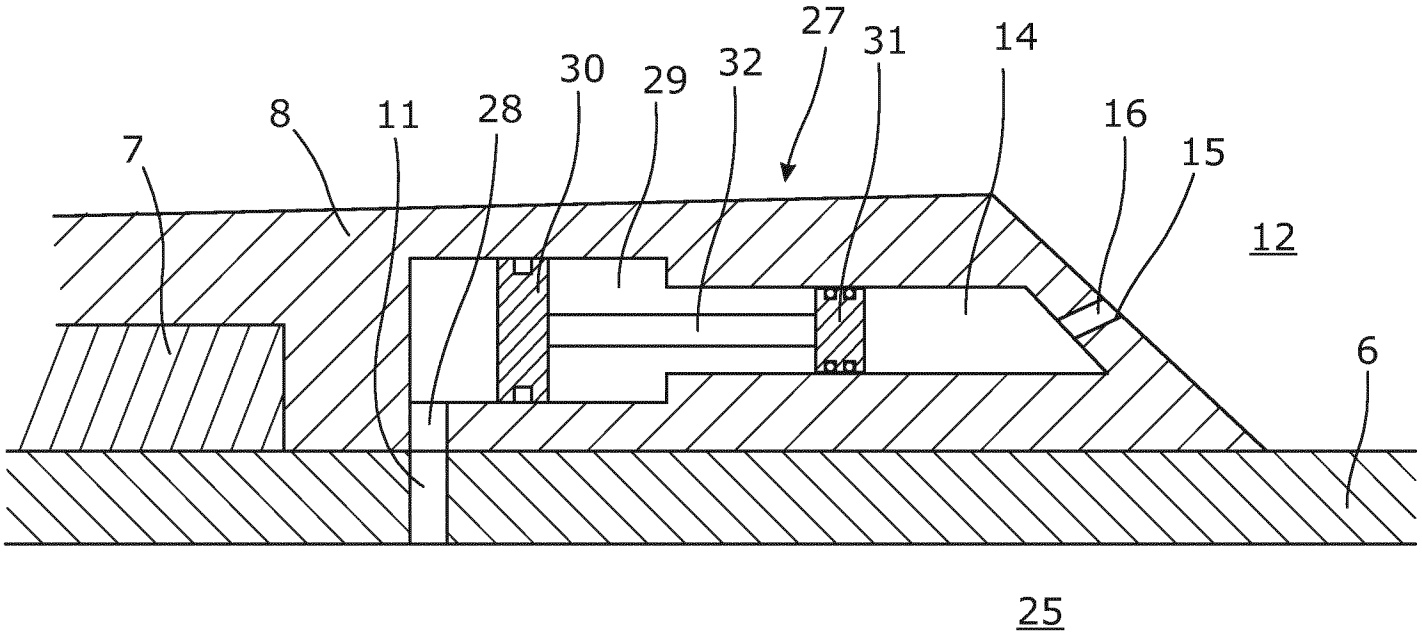
FIG. 10 shows a cross-sectional view of part of the annular barrier system.

As shown in FIG. 10, the connection part 8 comprises a pressure amplification unit 27 having an opening 28 being in fluid communication with an inside 25 of the tubular part 6 and a first chamber 29 and a first piston 30 moving in the first chamber 29 when a pressure in the tubular part 6 increases, the first piston 30 being connected to a second piston 31 by means of a shaft 32 moving in the gas chamber 14, forcing the gas into the annular space 12 when the first piston moves. In this way, the pressure inside the casing can be used to pressure gas in the gas chamber into the annular space 12 for leak-testing the annular barrier.

During completion of the well, mud, water, sand, gas or slurry may enter the first annulus 61, and before proceeding with the completion, it may be very useful to know what type of fluid is present in the first annulus. Therefore, as shown in FIG. 1, a fourth sensor 57 is arranged in the first annulus 61 which is arranged between the first metal casing 2 and the second metal casing 3. This sensor may continuously communicate with the top of the well.

Instead of pressurising the first annulus 61 to verify that the first and second annular barriers 4, 5 are providing a barrier, the fourth sensor 57 may be used for this purpose.

Figure 11:
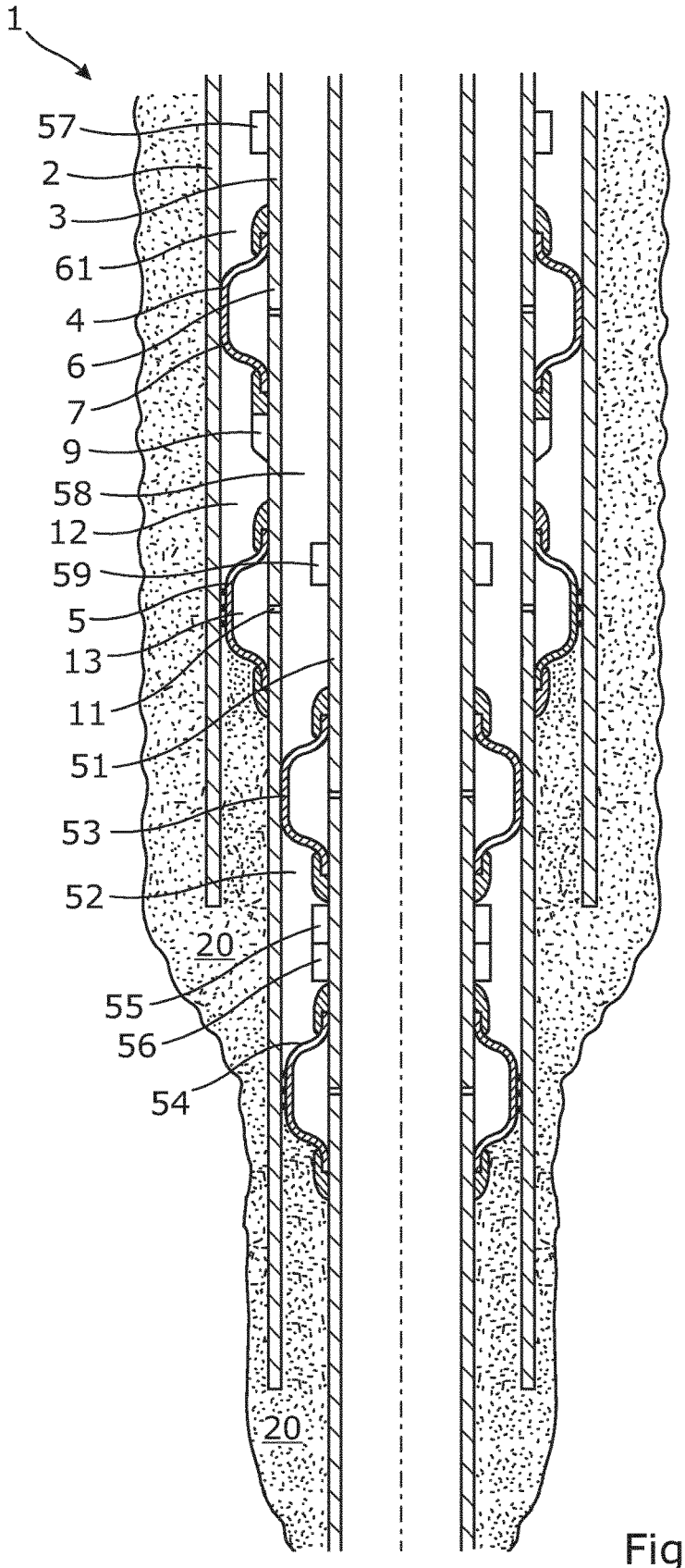
FIG. 11 shows a cross-sectional view of a yet another embodiment of the annular barrier system, the system having four annular barriers.

In FIG. 11, the annular barrier system further comprises a third metal casing 51 arranged inside the second metal casing 3. A third annular barrier 53 and a fourth annular barrier 54 are arranged so that their tubular part extending in a longitudinal direction is mounted as part of the third metal casing. The expandable sleeves of the third annular barrier 53 and fourth annular barrier 54 are expanded so as to abut the second metal casing 3. The system further comprises a second sensor 55 which is connected with the outer face of the tubular part, and when the expandable sleeves are expanded, a second annular space 52 is defined between the third and fourth annular barriers 53, 54 and the second and third metal casings 3, 51. The second sensor 55 is arranged in the space to determine a condition of the second annular space 52 in order to test the isolation ability of at least one of the third or fourth annular barriers 53, 54. By providing a third metal casing 51, a second annulus 58 is provided which can be tested to verify that the third and fourth annular barriers 53, 54 provide a second barrier 5. This testing is performed by pressurising the second annulus 58 from above, which is done in the well head at the top of the well, and if the annulus can maintain a certain pressure, the third and fourth annular barriers provide a second barrier.

The annular barrier system further comprises a second communication unit 56 connected with the third metal casing 51 and also connected with the second sensor 55 to receive information from the sensor arranged in the first annular space 12. By having such an intermediate communication unit, a tool can be lowered into the third casing 51 and load information from both the first 9 and the second sensor 55 in one run. The second communication unit may also communicate information from the second sensor 55 to the top of the well.

Figure 12:
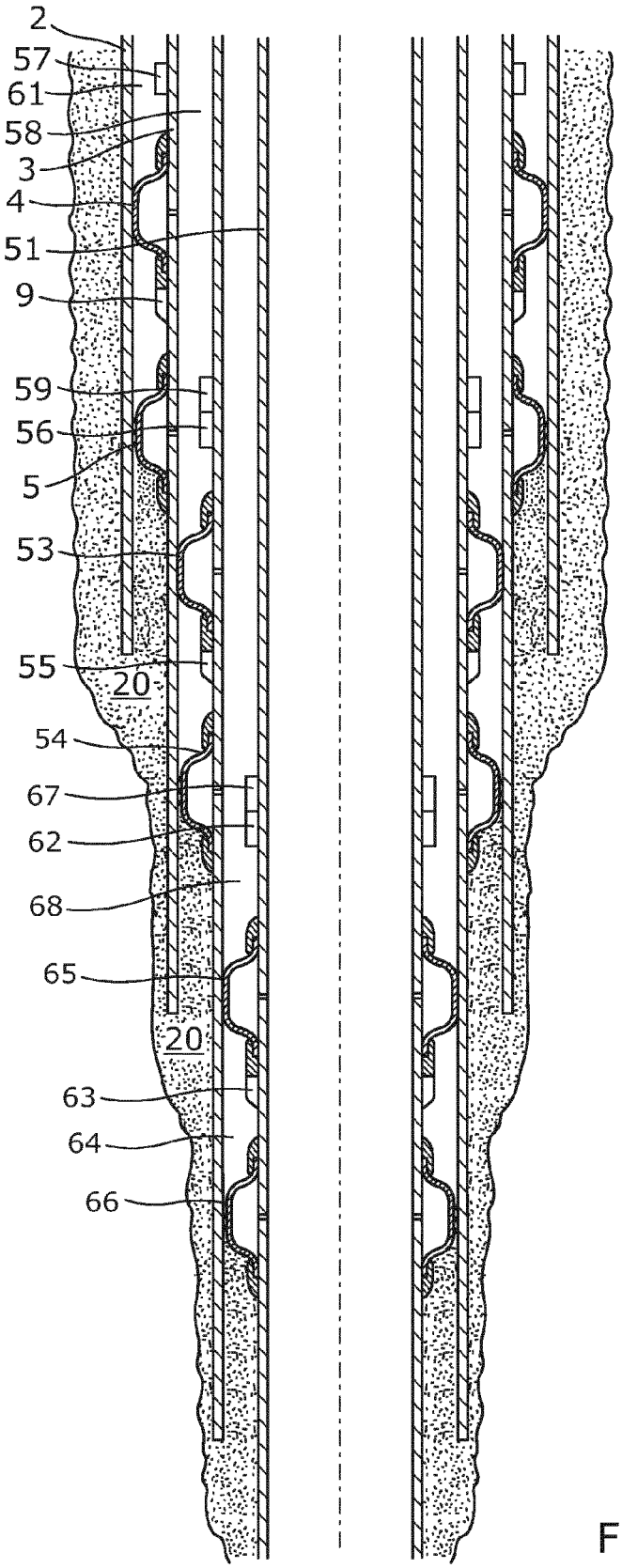
FIG. 12 shows a cross-sectional view of a yet another embodiment of the annular barrier system, the system having six annular barriers.

As shown in FIG. 12, the second communication unit 56 may also be arranged in the second annulus 58 which is arranged between the second metal casing 3 and the third metal casing 51. In this way, the communication unit is closer to the first sensor.

The annular barrier system shown in FIG. 11 further comprises a fifth sensor 59 arranged in the second annulus 58 which is arranged between the second metal casing 3 and the third metal casing 51. This fifth sensor 59 can be used to verify the integrity of the annular barriers and/or what kind of fluid is present in the second annulus 58.

In another embodiment shown in FIG. 12, the annular barrier system further comprises a fourth metal casing 61 arranged inside the third metal casing 51, creating a third annulus 68 therebetween. A fifth annular barrier 65 and sixth annular barrier 66 are arranged so that their tubular parts extend in a longitudinal direction and are mounted as part of the fourth metal casing 61. The system further comprises a third sensor 63 which is connected with the tubular part, and when the expandable sleeves of the fifth and sixth annular barriers 65, 66 are expanded to abut the third metal casing 51, a third annular space 64 is defined therebetween. The third sensor 63 is arranged in a similar manner to determine a condition of the third annular space 64 in order to test the isolation ability of at least one of the fifth and sixth annular barriers 65, 66. The third annulus 58 can be tested to verify that the fifth and sixth annular barriers provide a second barrier. This testing is performed by pressurising the third annulus 68 from above, which is done in the well head at the top of the well, and if the third annulus 68 can maintain a certain pressure, the fifth and sixth annular barriers provide a third barrier.

As shown, the annular barrier system further comprises a third communication unit 67 arranged in a third annulus 68 which is arranged between the second metal casing 3 and the third metal casing 51. The third communication unit is connected with the fourth metal casing 61 and a sixth sensor 62 to receive information from the second sensor 55 arranged in the second annular space 52. The sixth sensor 62 can also be arranged in connection with the third sensor 63 in the third annular space 64.

The sixth sensor 62 may also be used to confirm the integrity of the fifth and sixth annular barriers 65, 66 after expansion of the sleeves of the barriers. The sixth sensor 62 may furthermore be used to detect what kind of fluid is present in the third annulus during completion.

As can be seen in FIG. 6, the expandable sleeve may be surrounded by a sealing means 10 in order to provide a better seal against the first metal casing 2.

As can be seen in FIGS. 6-9, the tubular parts of the annular barriers are connected by means of a threaded connection and are spaced apart by an intermediate tubing, all forming part of the second metal casing 3.

The pressurised fluid used to expand the annular barrier may either be pressurised from the top of the well and fed through the casing 2, or be pressurised in a locally sealed off zone in the well tubular structure. The expansion fluid is applied until the expandable sleeve 7 abuts the inside wall of the first casing 2.

When the expandable sleeve 7 of the annular barrier 4, 5 is expanded, the diameter of the sleeve is expanded from its initial unexpanded diameter to a larger diameter. The expandable sleeve 7 has an outside diameter D and is capable of expanding to an at least 10% larger diameter, preferably an at least 15% larger diameter, and more preferably an at least 30% larger diameter than that of an unexpanded sleeve.

Furthermore, the expandable sleeve 7 has a wall thickness t which is thinner than a length L of the expandable sleeve, the thickness preferably being less than 25% of the length, more preferably less than 15% of the length, and even more preferably less than 10% of the length.

The expandable sleeve 7 of the annular barrier 4, 5 may be made of metal, polymers, an elastomeric material, silicone, or natural or synthetic rubber.

In order to increase the thickness of the sleeve 7, additional material may be applied (not shown) onto the expandable sleeve, e.g. by adding welded material onto the outer face. In another embodiment, the thickness of the sleeve 7 is increased by fastening a ring-shaped part onto the sleeve (not shown). In yet another embodiment, the increased thickness of the sleeve 7 is facilitated using a sleeve 7 varying in thickness (not shown). To obtain a sleeve of varying thickness, techniques such as rolling, extrusion or die-casting may be used.

An expansion tool may be used to expand the annular barrier and may comprise an isolation device for isolating a first section outside the passage or valve between an outside wall of the tool and the inside wall of the well tubular structure. The pressurised fluid is obtained by increasing the pressure of the fluid in the isolation device. When a section of the well tubular structure outside the passage of the tubular part is isolated, it is not necessary to pressurise the fluid in the entire well tubular structure, just as no additional plug is needed as is the case in prior art solutions. When the fluid has been injected into the space, the passage or valve is closed.

The tool may also use coiled tubing for expanding the expandable sleeve 7 of an annular barrier 4, 5 or of two annular barriers at the same time. A tool with coiled tubing can pressurise the fluid in the well tubular structure without having to isolate a section of the well tubular structure. However, the tool may need to plug the well tubular structure further down the borehole from the two annular barriers or barriers 1 to be operated. The annular barrier system of the present invention may also employ a drill pipe or a wireline tool to expand the sleeve.

In one embodiment, the tool comprises a reservoir containing the pressurised fluid, e.g. when the fluid used for expanding the sleeve 7 is cement, gas or a two-component compound.

The valve may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve or plug valve.

The expandable tubular metal sleeve 7 may be a cold-drawn or hot-drawn tubular structure. The sleeve may be seamless or welded.

The expandable tubular metal sleeve 7 may be extruded, die-cast or rolled, e.g. hot-rolled, cold-rolled, roll-bended, etc., and subsequently welded.

The fluid used for expanding the expandable sleeve 7 may be any kind of well fluid present in the borehole surrounding the tool and/or the well tubular structure. Also, the fluid may be cement, gas, water, polymers, or a two-component compound, such as powder or particles mixing or reacting with a binding or hardening agent. Part of the fluid, such as the hardening agent, may be present in the space before injecting a subsequent fluid into the space.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier system for proving testable annular barriers arranged between a first metal casing or borehole and a fixed second metal casing being fixed within the borehole, the second metal casing having an outer face, the annular barrier system comprising:

a first annular barrier and a second annular barrier, each barrier comprising:

a tubular part made of metal extending in a longitudinal direction for mounting as part of the fixed second metal casing, an expandable metal sleeve surrounding and being connected with the tubular part and defining an annular barrier space, and a first fluid passage in the tubular part for letting fluid into the annular barrier space to expand the sleeve, and the annular barrier system further comprising a sensor arranged in connection with the tubular part, and when the expandable sleeves are expanded to abut the first metal casing or borehole, a first annular space is defined between the annular barriers, wherein the sensor is arranged to determine a condition of the first annular space in order to test the isolation ability of at least one of the annular barriers.

2. An annular barrier system according to claim 1, wherein the sensor measures a property of the fluid to determine the condition of the annular space, the property being a temperature, a pressure, a presence of gas or a presence of a chemical tracer.

3. An annular barrier system according to claim 1, wherein the sensor is arranged in the annular space.

4. An annular barrier system according to claim 1, wherein the sensor is arranged in at least one of the annular barriers or is connected with at least one of the annular barriers.

5. An annular barrier system according to claim 1, wherein the sensor is arranged on an outer face of the expandable sleeve.

6. An annular barrier system according to claim 1, further comprising a readout unit arranged at the outer face of the tubular part and in electrical communication with the sensor.

7. An annular barrier system according to claim 1, further comprising a first communication unit arranged at the outer face of the tubular part of the first or second annular barrier for communicating data from the sensor to a reader.

8. An annular barrier system according to claim 7, wherein the first communication unit is arranged in a first annulus which is arranged between the second metal casing and the first metal casing or the borehole.

9. An annular barrier system according to claim 7, wherein the communication unit comprises a wireless sending unit sending data from the communication unit to the reader via inductance, Wlan, zigbee, or radio frequency.

10. An annular barrier system according to claim 1, further comprising a gas chamber having an outlet being in fluid communication with the annular space when a valve arranged in the outlet is opened for letting gas inside the gas chamber and into the annular space.

11. An annular barrier system according to claim 1, wherein the annular space is at least partly filled with cement.

12. An annular barrier system according to claim 1, further comprising:

the second metal casing, a third metal casing arranged inside the second metal casing, a third annular barrier and fourth annular barrier, a tubular part of each of the third and fourth annular barrier extending in a longitudinal direction for mounting as part of the third metal casing, and a second sensor arranged in connection with the tubular part of the third or the fourth annular barrier, and when the expandable sleeves of the third and fourth annular barriers are expanded to abut the second metal casing, a second annular space is defined between the third and fourth annular barriers, wherein the second sensor is arranged to determine a condition of the second annular space in order to test the isolation ability of at least one of the third or fourth annular barriers.

13. An annular barrier system according to claim 12, further comprising a second communication unit connected with the third metal casing and/or the second sensor to receive information from the sensor arranged for determining a condition of the first annular space.

14. An annular barrier system according to claim 13, wherein the second communication unit is arranged in a second annulus which is arranged between the second metal casing and the third metal casing.

15. An annular barrier system according to claim 12, further comprising:

a fourth metal casing arranged inside the third metal casing, a fifth annular barrier and sixth annular barrier, the tubular part of the fifth and sixth annular barrier extending in a longitudinal direction for mounting as part of the fourth metal casing, and a third sensor arranged in connection with the tubular part, and when the expandable sleeves of the fifth and sixth annular barriers are expanded to abut the third metal casing, a third annular space is defined between the fifth and sixth annular barriers, wherein the third sensor is arranged to determine a condition of the third annular space in order to test the isolation ability of at least one of the fifth and sixth annular barriers.

16. An annular barrier system according to claim 15, further comprising a third communication unit connected with the fourth metal casing and/or a third sensor to receive information from the second sensor arranged for determining a condition of the second annular space.

17. An annular barrier system according to claim 16, wherein the third communication unit is arranged in a third annulus which is arranged between the second metal casing and the third metal casing.

18. A method of testing a pressure integrity of a well using a system according to claim 1, the method comprising:

expanding the expandable sleeves of the first and second annular barriers, thereby providing the first annular space, creating an increased property of the fluid in the first annular space, and measuring the property by the sensor.

19. A method according to claim 18, further comprising lowering a tool comprising the sensor into the well to measure the property of the fluid in the annular space.

* * * * *